US011448102B2

(12) United States Patent
Cecchi et al.

(10) Patent No.: US 11,448,102 B2
(45) Date of Patent: Sep. 20, 2022

(54) ACTUATION APPARATUS

(71) Applicant: Eaton Intelligent Power Limited, Dublin (IE)

(72) Inventors: Michele Cecchi, Turin (IT); Gennaro Buonocore, Turin (IT); Fabrizio Dallacqua, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 665 days.

(21) Appl. No.: 16/304,146

(22) PCT Filed: May 23, 2017

(86) PCT No.: PCT/EP2017/062413
§ 371 (c)(1),
(2) Date: Nov. 22, 2018

(87) PCT Pub. No.: WO2017/202845
PCT Pub. Date: Nov. 30, 2017

(65) Prior Publication Data

US 2020/0318500 A1 Oct. 8, 2020

(30) Foreign Application Priority Data

May 24, 2016 (GB) ..... 1609113

(51) Int. Cl.
*F01L 1/18* (2006.01)
*F02M 26/01* (2016.01)
(Continued)

(52) U.S. Cl.
CPC ..... *F01L 1/185* (2013.01); *F01L 13/0015* (2013.01); *F02M 26/01* (2016.02); *F01L 1/22* (2013.01); *F01L 2001/186* (2013.01)

(58) Field of Classification Search
CPC ..... F01L 1/185; F01L 1/22; F01L 13/0005; F01L 13/0015; F01L 2001/186;
(Continued)

(56) References Cited

U.S. PATENT DOCUMENTS 4,828,077 A * 5/1989 Stevens, Jr. ..... F16D 55/02 188/163
5,653,198 A * 8/1997 Diggs ..... F01L 1/185 123/90.16
(Continued)

FOREIGN PATENT DOCUMENTS

CN 201972748 U 9/2011
GB 2526554 A 12/2015
(Continued)

*Primary Examiner* — Devon C Kramer
*Assistant Examiner* — Kelsey L Stanek
(74) *Attorney, Agent, or Firm* — Mei & Mark, LLP

(57) ABSTRACT

An actuation transmission apparatus for actuating a component of a switchable valve train device of an internal combustion engine includes: a shaft rotatable by an actuation source; a contacting element for contacting the component of the switchable valve train device; and a biasing device for biasing the contacting element rotationally with respect to the shaft; wherein, in use, the biasing device becomes biased by the shaft when the actuation source rotates the shaft when the actuation source attempts to actuate the component of the switchable valve train device, via the contacting element, when the component of the switchable valve train device is not able to be actuated, whereby the biasing device is configured to cause the contacting element to actuate the component of the switchable valve train device when the component of the switchable valve train device becomes actuatable again.

19 Claims, 9 Drawing Sheets

(51) Int. Cl.
*F01L 13/00* (2006.01)
*F01L 1/22* (2006.01)

(58) Field of Classification Search
CPC ..... F01L 2013/001; F01L 2820/031; F01L 2105/00; F02M 26/01
USPC ..... 123/90.16, 90.41, 198 F
See application file for complete search history.

(56) References Cited

U.S. PATENT DOCUMENTS

| | | | | |
|---|---|---|---|---|
| 6,314,928 | B1 * | 11/2001 | Baraszu | F01L 13/0005 123/90.16 |
| 2005/0092273 | A1 | 5/2005 | Cecur et al. | |
| 2014/0013739 | A1 * | 1/2014 | Gonzalez Delgado | F02D 13/0273 60/605.2 |
| 2015/0128890 | A1 * | 5/2015 | Cecur | F01L 1/18 123/90.16 |
| 2016/0076439 | A1 * | 3/2016 | Martens | F01D 17/16 415/150 |
| 2018/0363518 | A1 * | 12/2018 | Raimondi | F01L 13/0036 |
| 2019/0120090 | A1 * | 4/2019 | Andrisani | F01L 1/18 |

FOREIGN PATENT DOCUMENTS

| | | | |
|---|---|---|---|
| JP | 2008196497 | A | 8/2008 |
| JP | 2008202580 | A | 9/2008 |
| WO | WO 2013156610 | A1 | 10/2013 |

* cited by examiner

ACTUATION APPARATUS

CROSS-REFERENCE TO PRIOR APPLICATIONS

This application is a U.S. National Phase application under 35 U.S.C. § 371 of International Application No. PCT/EP2017/062413, filed on May 23, 2017, and claims benefit to British Patent Application No. GB 1609113.4, filed on May 24, 2016. The International Application was published in English on Nov. 30, 2017 as WO 2017/202845 under PCT Article 21(2).

FIELD

The present invention relates to actuation, and more specifically actuation of components of switchable engine or valve train devices of an internal combustion engine.

BACKGROUND

Internal combustion engines may comprise switchable engine or valve train devices. For example, valve train assemblies may comprise a switchable rocker arm to provide for control of valve actuation by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

WO 2013/156610 A1 [EATON SRL] discloses such a dual lift rocker arm with a moveable latch pin. The default position of the latch pin is unlatched, and it is retained in this position using a biasing device. When required, the latch pin is actuated to the latched position using an external actuation mechanism based on a leaf spring. When actuation is required, the leaf spring is controlled to rotate a certain amount so as to engage with a roller of the latch pin, and hence push the latch pin into the latched position.

The transmission of an actuation force to a component of a switchable valve train or engine device such as a switchable rocker arm can be difficult due to packaging constraints and functional requirements. Also, in some cases, actuation may not be possible immediately due to an engine condition.

It is desirable to provide an actuation transmission system that addresses these problems.

SUMMARY

In an embodiment, the present invention provides an actuation transmission apparatus for actuating a component of a switchable valve train device of an internal combustion engine, the apparatus comprising: a shaft rotatable by an actuation source; a contacting element configured to contact the component of the switchable valve train device; and a biasing device configured to bias the contacting element rotationally with respect to the shaft; wherein, in use, the biasing device becomes biased by the shaft when the actuation source rotates the shaft when the actuation source attempts to actuate the component of the switchable valve train device, via the contacting element, when the component of the switchable valve train device is not able to be actuated, whereby the biasing device is configured to cause the contacting element to actuate the component of the switchable valve train device when the component of the switchable valve train device becomes actuatable again.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
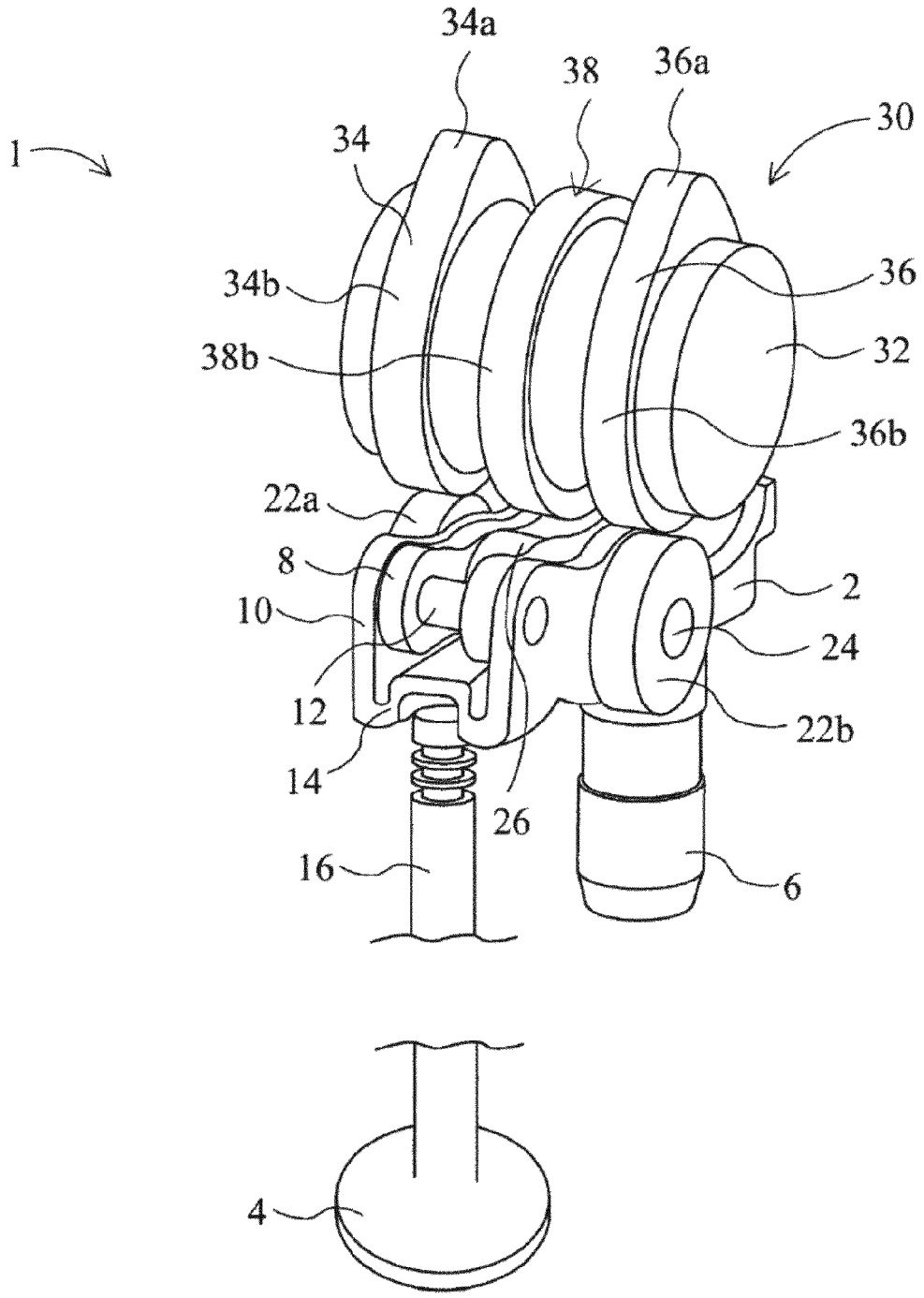
FIG. 1 illustrates a schematic perspective view of an example valve train assembly including an example rocker arm, according to a first example.

According to a first aspect of the present invention, there is provided an actuation transmission apparatus for actuating a component of a switchable valve train device of an internal combustion engine, the apparatus comprising: a shaft rotatable by an actuation source; a contacting element for contacting the component of the switchable valve train device; and a biasing device to bias the contacting element rotationally with respect to the shaft; wherein, in use, the biasing device becomes biased by the shaft when the actuation source rotates the shaft when the actuation source attempts to actuate the component of the switchable valve train device via the contacting element, when the component of the switchable valve train device is not able to be actuated, whereby the biasing device causes the contacting element to actuate the component of the switchable valve train device when the component of the switchable valve train device becomes actuatable again.

The biasing device may be a coil spring arranged around the shaft.

The actuation transmission apparatus may comprise a pre-load element for transferring torque from the shaft to the coil spring.

A first end of the coil spring may contact a protrusion of the pre-load element, and a second end of the coil spring may contact the contacting element (212), thereby to bias the contacting element rotationally with respect to the shaft.

The contacting element may extend radially from the shaft.

The contacting element may define a curved surface for contacting the component of the switchable valve train component device.

The actuation transmission apparatus may comprise a lever mechanically coupled to the shaft and extending radially therefrom, the lever being rotatable, by the actuation source, about an axis of the shaft, thereby allowing the shaft to be rotatable by the actuation source.

The lever may comprise one or more mechanical stopping features to restrict an extent of rotation of the lever about the axis of the shaft.

The actuation transmission apparatus may comprise a support body for supporting the shaft, wherein the support body comprises one or more protrusions for abutting against the one or more mechanical stopping features of the lever thereby to restrict the extent of rotation of the lever about the axis of the shaft.

The actuation transmission apparatus may comprise a second biasing device arranged to bias the shaft rotationally with respect to the support body.

The actuation transmission apparatus may comprise a plurality of said contacting elements for contacting a respective plurality of said components of said switchable valve train devices, a respective plurality of said biasing device to bias the respective contacting elements rotationally with respect to the shaft, and the shaft may be common to each of the plurality of contacting elements.

According to a second aspect of the present invention, there is provided a valve train assembly of an internal combustion engine, the valve train assembly comprising:

the actuation transmission apparatus according to the first aspect; a said actuation source; and a said switchable valve train device comprising a said component.

In use, when the actuation source rotates the shaft when the actuation source attempts to actuate the component of the switchable valve train device, via the contacting element, when the component of the switchable valve train device is actuatable, the contacting element may actuate the component of the switchable valve train device immediately.

The switchable valve train device may be a switchable rocker arm.

The switchable rocker arm may comprise a first body and a second body, and the component of the switchable rocker arm may be a latching arrangement comprising a moveable latch pin for latching the first body and the second body together.

Actuating the latching arrangement of the switchable rocker arm may comprise moving the latch pin from an unlatched position in which the first body and the second body are unlatched so that the first body and the second body are moveable relative to one another, to a latched position in which the first body and the second body are latched together.

The switchable rocker arm may comprise a biasing element to bias the latch pin towards the unlatched position.

When the actuation source rotates the shaft when the actuation source attempts to actuate the latch pin of the switchable rocker arm, the contacting element may be caused to exert a force on the latching arrangement in a direction towards the first body and the second body.

The switchable rocker arm may be arranged such that, when the first body and the second body are unlatched, the switchable rocker arm provides a first mode of operation, and when the first body and the second body are latched together by the latch pin, the switchable rocker arm provides a second mode of operation.

The second mode of operation may be internal exhaust gas recirculation.

The actuation source may comprise a drive element controllable to rotate a drive rod about an axis of rotation of the drive rod.

The axis of rotation of the drive rod may be substantially perpendicular to the axis of rotation of the shaft.

The actuation source may comprise a coupler extending radially from the drive rod and for contacting the lever, and arranged to transform rotational movement of the drive rod about the axis of the drive rod to rotational movement of the shaft about the axis of the shaft.

According to a third aspect of the present invention, there is provided a method of actuating a component of a switchable valve train device of an internal combustion engine, the method comprising: rotating a shaft so as to bias, when the component of the switchable valve train device is not able to be actuated, a biasing device that biases a contacting element rotationally with respect to the shaft, the contacting element being for contacting the component of the switchable valve train device, whereby the biasing device causes the contacting element to actuate the component of the switchable valve train device when the component of the switchable valve train device becomes actuatable again.

Further features and advantages of the invention will become apparent from the following description of preferred embodiments of the invention, given by way of example only, which is made with reference to the accompanying drawings. In the following, like parts are given like reference numerals.

To facilitate understanding of the present invention, first a valve train assembly 1 according to a first example is described with reference to FIGS. 1 to 6. Following this, a valve train assembly 1', comprising an actuation transmission apparatus 200, according to a second example is described with reference to FIGS. 7 to 9.

Figure 2:
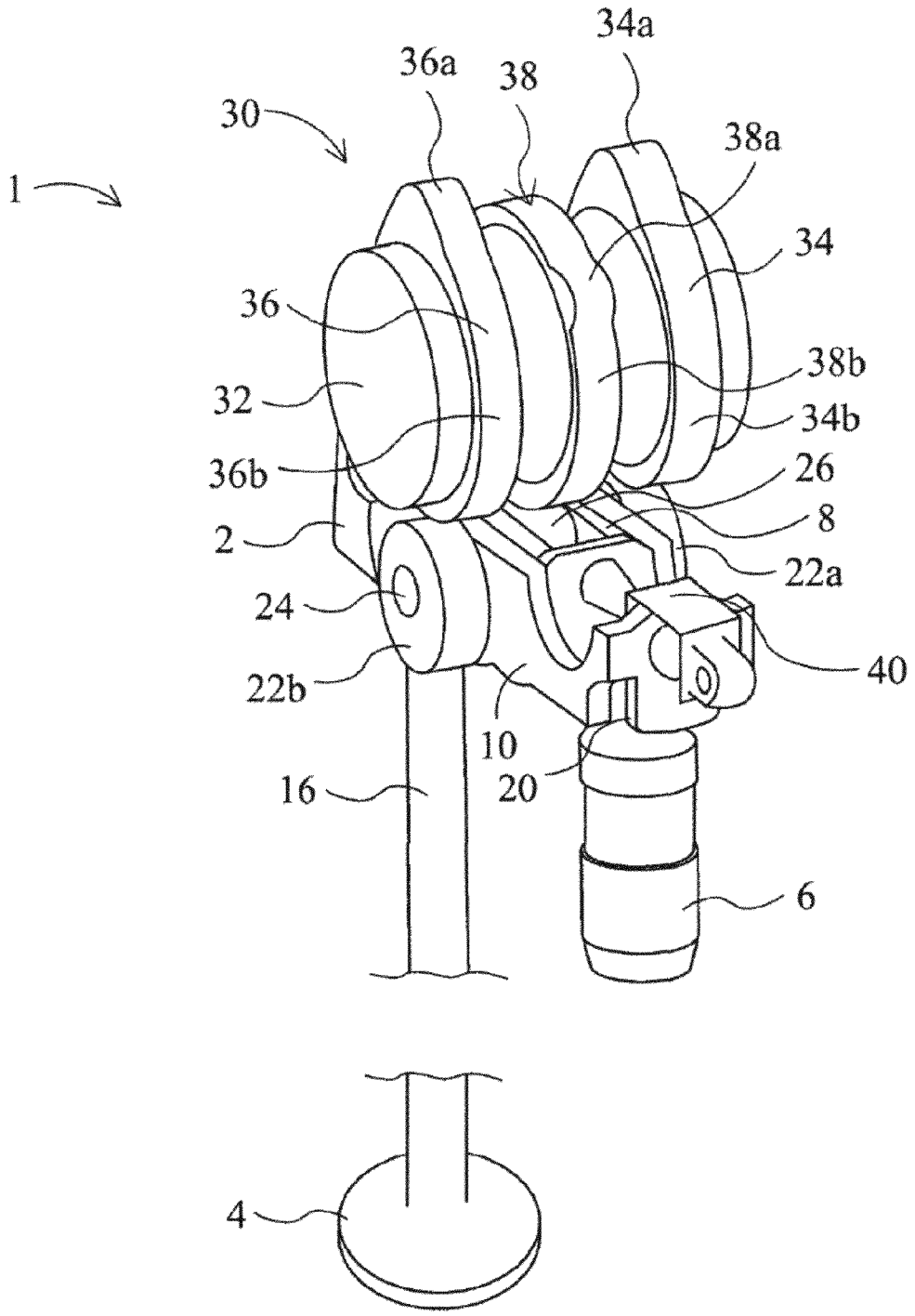
FIG. 2 illustrates another perspective view of the example valve train assembly.

FIGS. 1 and 2 illustrate schematically a valve train assembly 1 comprising a rocker arm 2 according to the first example. Although the example rocker arm 2 is referred to in the below, it will be appreciated that the rocker arm 2 may be any rocker arm comprising a plurality of bodies that move relative to one another, and which are latched together to provide one mode of operation (a latched valve-lift mode) and are unlatched, and hence can move with respect to each other, to provide a second mode of operation (an un-latched valve-lift mode).

Referring again to the example of FIGS. 1 and 2, a valve train assembly 1 comprises a rocker arm 2, an engine valve 4 for an internal combustion engine cylinder and a lash adjustor 6. The rocker arm 2 comprises an inner body or arm 8 and an outer body or arm 10. The inner body 8 is pivotally mounted on a shaft 12 which serves to link the inner body 8 and outer body 10 together. The shaft 12 is received through apertures 70*a* and 70*b* in side walls 60 and 62 of the outer body 10, and through apertures 46*a* and 46*b* in the inner body 8. A base 64*a* connects the side walls 60, 62 of the outer body 10. A first end 14 of the outer body 10 engages the stem 16 of the valve 4 and at a second end 20 the outer body 10 is mounted for pivotal movement on the lash adjustor 6 which is supported in an engine block. The lash adjuster 6, which may for example be a hydraulic lash adjuster, is used to accommodate slack between components in the valve train assembly 1. Lash adjusters are well known per se and so the lash adjuster 6 will not be described in detail.

The rocker arm 2 is provided with a pair of main lift rollers 22*a* and 22*b* rotatably mounted on an axle 24 carried by the outer body 10. One of the main lift rollers 22*a* is located one side of the outer body 10 and the other of the main lift rollers 22*b* is located the other side of the outer body 10. The rocker arm 2 is further provided with a secondary lift roller 26, located within the inner body 8 and rotatably mounted on an axle (not visible in FIGS. 1 and 2) carried by the inner body 8.

A three lobed camshaft 30 comprises a rotatable camshaft 32 mounted on which are first 34 and second 36 main lift cams and a secondary lift cam 38. The secondary lift cam 38 is positioned between the two main lift cams 34 and 36. The first main lift cam 34 is for engaging the first main lift roller 22*a*, the second main lift cam 36 is for engaging the second main lift roller 22*b* and the secondary lift cam 38 is for engaging the secondary lift roller 26. The first main lift cam 34 comprises a lift profile (i.e. a lobe) 34*a* and a base circle 34*b*, second main lift cam 36 comprises a lift profile 36*a* and a base circle 36*b* and the secondary lift cam 38 comprises a lift profile 38*a* and a base circle 38*b*. The lift profiles 34*a* and 36*a* are substantially of the same dimensions as each other and are angularly aligned. The lift profile 38*a* is smaller than the lift profiles 34*a* abd 36*a* (both in terms of the height of its peak and in terms of the length of its base) and is angularly offset from them.

The rocker arm 2 is switchable between a dual lift mode which provides two operations of the valve 4 (a valve operation is an opening and corresponding closing of the valve) per engine cycle (e.g. full rotation of the cam shaft 32) and a single lift mode which provides a single operation of the valve 4 per engine cycle. In the dual lift mode, the inner body 8 and the outer body 10 are latched together by a latching arrangement 40 (see FIG. 2) and hence act as a single solid body. With this particular arrangement, the dual lift mode provides a higher main valve lift and a smaller secondary valve lift per engine cycle. The single lift mode provides just the main valve lift per engine cycle. The single lift mode is an example of a first valve-lift mode, and the dual lift mode is an example of a second valve-lift mode of the valve train assembly 1.

During engine operation in the dual lift mode, as the cam shaft 32 rotates, the first main lift cam's lift profile 34*a* engages the first main lift roller 22*a* whilst, simultaneously, the second main lift cam's lift profile 36*a* engages the second main lift roller 22*b* and together they exert a force that causes the outer body 10 to pivot about the lash adjuster 6 to lift the valve stem 16 (i.e. move it downwards in the sense of the page) against the force of a valve spring thus opening the valve 4. As the peaks of the lift profiles 34*a* and 36*a* respectively pass out of engagement with the first main lift roller 22*a* and the second main lift roller 22*b*, the valve spring begins to close the valve 4 (i.e. the valve stem 16 is moved upwards in the sense of the page). When the first main lift cam's base circle 34*b* again engages the first main lift roller 22*a* and the second main lift cam's 36 lift profile engages the second main lift roller 22*b* the valve is fully closed and the main valve lift event is complete.

As the camshaft 32 continues to rotate, then, the secondary lift cam's lift profile 38*a* engages the secondary lift roller 26 exerting a force on the inner body 8 which force, as the inner body 8 and the outer body 10 are latched together, is transmitted to the outer body 10 causing the outer body 10 to pivot about the lash adjuster 6 to lift the valve stem 16 against the force of a valve spring thus opening the valve 4 a second time during the engine cycle. As the peak of the lift profile 38*a* passes out of engagement with the secondary lift roller 26 the valve spring begins to close the valve 4 again. When the secondary lift cam's base circle 38*b* again engages the secondary lift roller 26 the valve 4 is fully closed and the second valve lift event for the current engine cycle is complete.

The lift profile 38*a* is shallower and narrower than are the lift profiles 34*a* and 36*a* and so consequently the second valve lift event is lower and of a shorter duration than is the first valve lift event.

In the single lift mode the inner body 8 and the outer body 10 are not latched together by the latching arrangement 40 and hence in this mode, the inner body 8 is free to pivot with respect to the outer body 10 about the shaft 12. During engine operation in the single lift mode, as the cam shaft 32 rotates, when the first main lift cam's lift profile 34*a* engages the first main lift roller 22*a* and the second main lift cam's lift profile 36*a* engages the second main lift roller 22*b*, the outer body 10 pivots about the lash adjuster 6 and, in an identical way as in the dual lift mode, a main valve lift event occurs. As the camshaft 32 continues to rotate, then, the secondary lift cam's lift profile 38*a* engages the secondary lift roller 26 exerting a force on the inner body 8. In the single lift mode, however, as the inner body 8 and the outer body 10 are not latched together, this force is not transmitted to the outer body 10 which hence does not pivot about the lash adjuster 6 and so there is no additional valve event during the engine cycle. Instead, as the secondary lift cam's lift profile 38*a* engages the secondary lift roller 26, the inner body 8 pivots with respect to the outer body 10 about the shaft 12 accommodating the motion that otherwise would be transferred to the outer body 10. A torsional lost motion spring (not shown in FIGS. 1 and 2) is provided to return the inner body 8 to its starting position relative to the outer body 10, once the peak of the lift profile 38*a* has passed out of engagement with the secondary lift roller 26.

This arrangement may be used to provide switchable Internal Exhaust Gas Recirculation (IEGR) control. For example, if the valve 4 is an exhaust valve for an engine cylinder, the main valve lift acts as the main exhaust lift of an engine cycle, and the timing of the secondary valve lift may be arranged so that it occurs when an intake valve for that cylinder, controlled by a further rocker arm mounted pivotally on a further lash adjuster and which pivots in response to an intake cam mounted on the cam shaft 32, is open. The simultaneous opening of the intake and exhaust valves in this way ensures that a certain amount of exhaust gas remains in the cylinder during combustion which, as is well known, reduces NOx emissions. Switching to the single lift mode deactivates the IEGR function, which deactivation may be desirable under certain engine operating conditions. As will be appreciated by those skilled in the art, this switchable IEGR control may also be provided if the valve 4 is an intake valve with the timing of the secondary valve lift arranged to occur when an exhaust valve for that cylinder is open during the exhaust part of an engine cycle.

Figure 3:
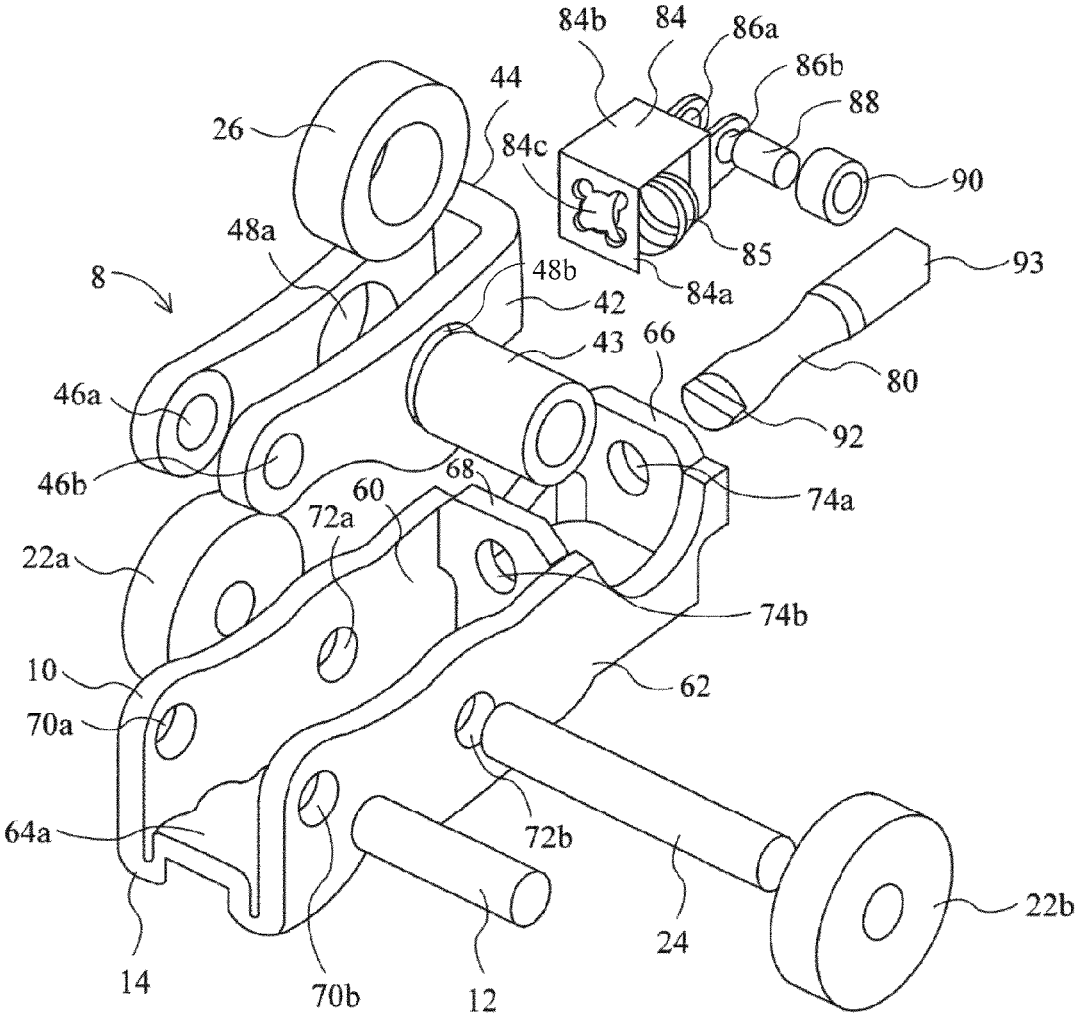
FIG. 3 is an exploded view of the example rocker arm.

As is best understood from FIG. 3, the secondary lift roller 26 is mounted on a hollow inner bushing/axle 43 which is supported in the apertures 48*a* and 48*b*. The axle 24 extends through the inner bushing/axle 43 (and hence through the inner roller 26) and the diameter of the axle 24 is somewhat smaller than the inner diameter of the inner bushing/axle 43 to allow movement of the assembly of the inner body 8, axle 43 and inner roller 26 relative to the outer body 10. The main lift rollers 22*a* and 22*b* are therefore arranged along a common longitudinal axis and the secondary lift roller 26 is arranged along a longitudinal axis that is slightly offset from this. This arrangement of axles and rollers ensures that the rocker 2 arm is compact and facilitates manufacturing the first 10 and second 8 bodies from stamped metal sheets.

As is also best seen from FIG. 3, the latching arrangement 40 comprises the latch pin 80 and an actuation member 84. The actuation member 84 comprises a sheet bent along its width to form first 84*a* and second 84*b* rectangular portions which define a right angle. The first portion 84*a* defines a hole 84*c*. The actuation member 84 further comprises a pair of winged portions extending rearwardly from the second portion 84*c* each of which defines a respective one of a pair of apertures 86*a*, 86*b* for supporting a shaft 88 on which is mounted a roller 90. The actuation member 84 straddles the end wall 66 of the outer body 10 with the second portion 84*c* slidably supported on the end wall 66 with the first portion 84*a* positioned between the end wall 66 and the inner wall 68 of the outer body 10. At one end, the latch pin 80 defines an upward facing latch surface 92.

As seen in FIGS. 4 and 5, the latch pin 80 extends through the holes 74*a* in the end wall 66 and the hole 84*c* in the actuation member 84 and its end 93 engages the wing portions of the actuation member 84.

Figure 4A:
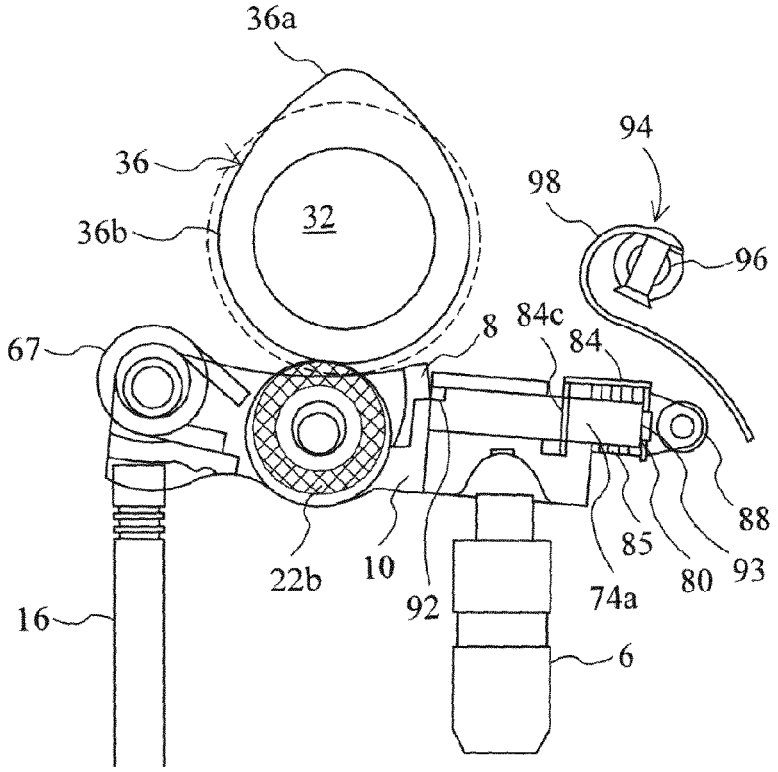
FIGS. 4*a* and 4*b* schematically illustrate the example valve train assembly at two different points in engine cycle when the inner and outer bodies are latched.
Figure 4B:
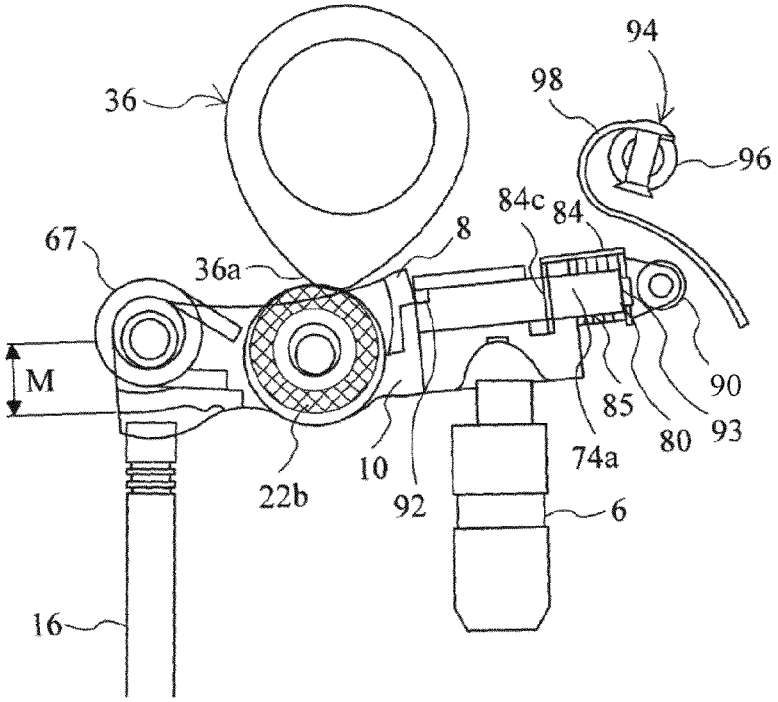

FIGS. 4*a* and 4*b* illustrate the valve train assembly 1 when the rocker arm 2 is in the single lift mode (i.e. unlatched configuration). In this configuration, the actuation member 84 and latch pin 80 are positioned so that the latch surface 92 does not extend through the hole 74*b* and so does not engage the latch contact surface 54 of the inner body 8. In this configuration, the inner body 8 is free to pivot, with respect to the outer body 10, about the shaft 12 when the secondary roller 26 engages the lift profile 38*a* and hence there is no additional valve event. It will be appreciated that the amount of movement available to the inner body 8 relative to the outer body 10 (i.e. the amount of lost motion absorbed by the inner body 8) is defined by the size difference between the diameter of the axle 24 and the inner diameter of the inner bushing/axle 43. The torsional spring 67, which is installed over the top of the valve stem 16 and is located inside the inner body 10 by the shaft 12, acts as a lost motion spring that returns the inner body 8 to its starting position with respect to the outer body 10 after it has pivoted.

Figure 5A:
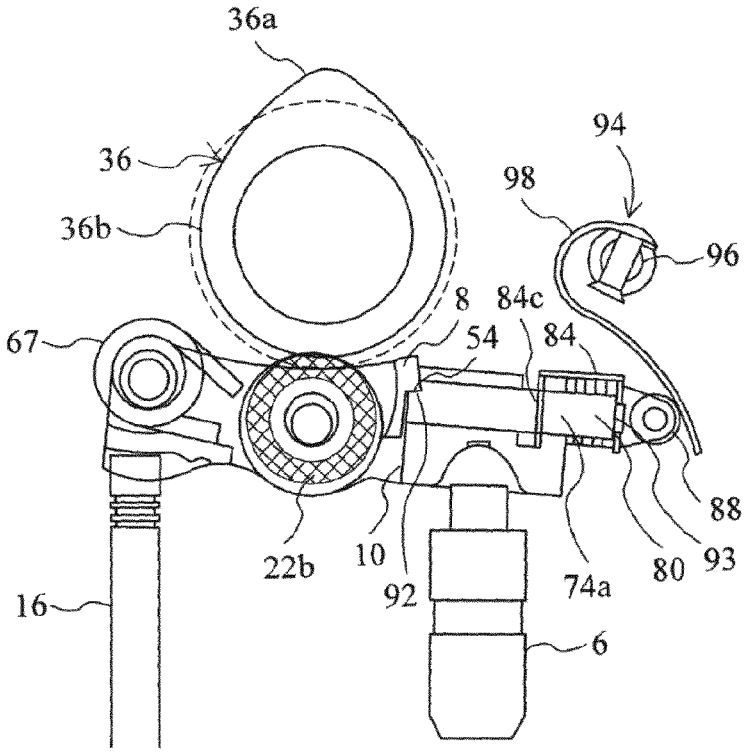
FIGS. 5*a* and 5*b* schematically illustrate the example valve train assembly at two different points in engine cycle when the inner and outer bodies are un-latched.
Figure 5B:
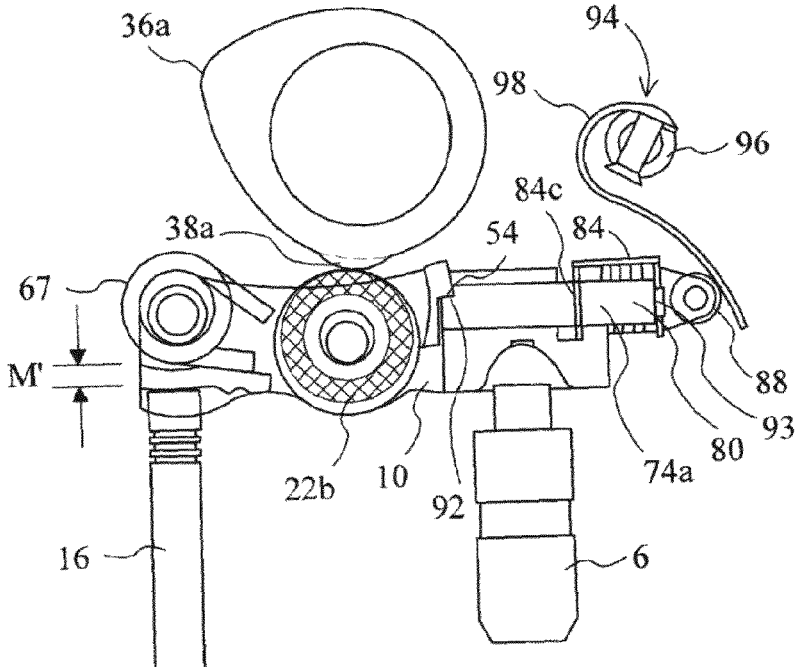

FIGS. 5*a* and 5*b* illustrate the valve train assembly 1 when the rocker arm 2 is in the dual lift mode (i.e. a latched configuration). In this configuration, the actuation member 84 and latch pin 80 are moved forward (i.e. to the left in the sense of FIGS. 5*a* and 5*b*) relative to their positions in the unlatched configuration so that the latch surface 92 does extend through the hole 74*b* so as to engage the latch contact surface 54 of the inner body 8. As explained above, in this configuration, the inner body 8 and the outer 110 act as a solid body so that when the when the secondary roller 26 engages the lift profile 38*a* there is an additional valve event.

An actuator 94 is provided to move the latching arrangement 40 between the un-latched and latched positions. In this example, the actuator comprises an actuator shaft 96 carrying a biasing device 98, which in this example comprises a flexible strip, for example a leaf spring. In the default unlatched configuration, the leaf spring 98 does not engage the latching arrangement 40. To enter the latched configuration, the shaft 96 is rotated a certain amount (for example 12 degrees) causing the leaf spring 98 to engage the roller 90 and to push the latching arrangement 40 into the latched position. A spring 85 mounted over the latch pin 80 and supported between an outer face of the end wall 66 and the winged members of the member 84 is biased to cause the latching arrangement 40 to return to its unlatched position when the actuator shaft 96 is rotated back to its unlatched position and the leaf spring 98 disengages the roller 90.

When the base circle 38*b* engages the inner bushing/axle 43, the inner bushing axle 43 stops on the axle 24 which ensures that the orientation of the various components is such that the latch pin 80 is free to move in and out of the latched and unlatched positions.

FIG. 4*a* illustrates the valve train assembly 1 when the rocker arm 2 is in the single lift mode (i.e. the un-latched configuration) at a point in an engine cycle when the main lift rollers 22*a* and 22*b* are engaging the respective base circles 34*b* and 36*b* of the first main lift cam 34 and the second main lift cam 36. At this point in the engine cycle, the valve 4 is closed. FIG. 4*b* illustrates the valve train assembly 1 when the rocker arm 2 is in the single lift mode at another point in an engine cycle when the main lift rollers 22*a* and 22*b* are engaging the respective peaks of the lift profiles 34*a* and 36*a* of the first main lift cam 34 and the second main lift cam 36. At this point in the engine cycle the valve 4 is fully open and the 'maximum lift' of the main valve event is indicated as M.

FIG. 5*a* illustrates the valve train assembly 1 when the rocker arm 2 is in the dual lift mode (i.e. the latched configuration) at a point in an engine cycle when the main lift rollers 22*a* and 22*b* are engaging the respective base circles 34*b* and 36*b* of the first main lift cam 34 and the secondary lift roller 26 is engaging the base circle 38*b* of the secondary lift cam 38. At this point in the engine cycle, the valve 4 is closed. FIG. 5*b* illustrates the valve train assembly 1 when the rocker arm 2 is in the single lift mode at another point in an engine cycle when the main lift rollers 22*a* and 22*b* are engaging the respective base circles 34*b* and 36*b* of the first main lift cam 34 and the second main lift cam 36 and the secondary lift roller 26 is engaging the peak of the lift profile 38*a* of the secondary lift cam 38. At this point in the engine cycle the valve 4 is fully open during the additional valve event and the 'maximum lift' of the secondary valve event is indicated as M'.

Figure 6:
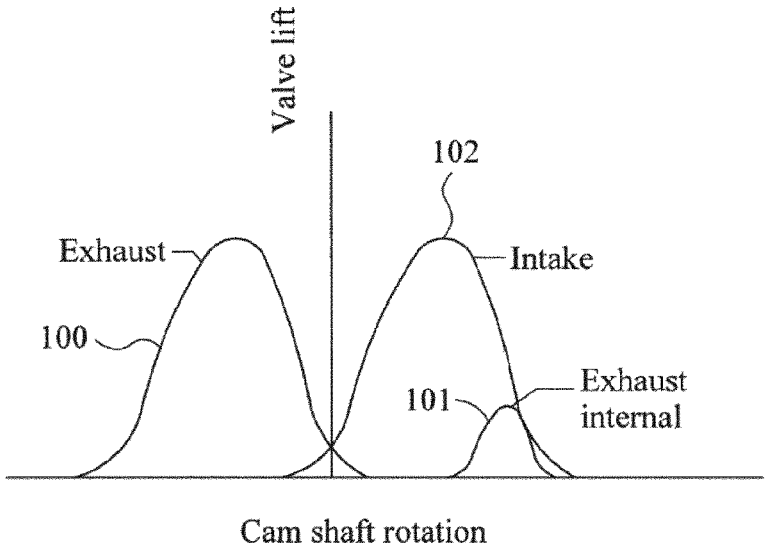
FIG. 6 illustrates a graph showing valve lift against cam shaft rotation.

FIG. 6 illustrates a graph in which the Y axis indicates valve lift and the X axis indicates rotation of the cam shaft. In the example of the valve 4 being an exhaust valve, the curve 100 represents the main lift of the exhaust valve during an engine cycle and the curve 101 represents the additional lift of the exhaust valve during the subsequent engine cycle. The curve 102 represents the lift of intake valve, during the subsequent engine cycle, operated by an intake rocker arm in response to an intake cam mounted on the cam shaft. It can be seen that the cams are arranged so that in any given engine cycle, the additional smaller opening of the exhaust valve occurs when the intake valve is open to thereby provide a degree of internal exhaust gas recirculation.

As previously mentioned, in an alternative arrangement the valve 4 is an intake valve rather than an exhaust valve (making the rocker arm 2 an intake rocker arm) and an exhaust rocker arm operates an exhaust valve in response to an exhaust cam mounted on the cam shaft. In this alternative arrangement the cams are arranged so that in any given engine cycle, the additional smaller opening of the intake valve occurs when the exhaust valve is open to thereby provide a degree of internal exhaust gas recirculation.

Figure 7:
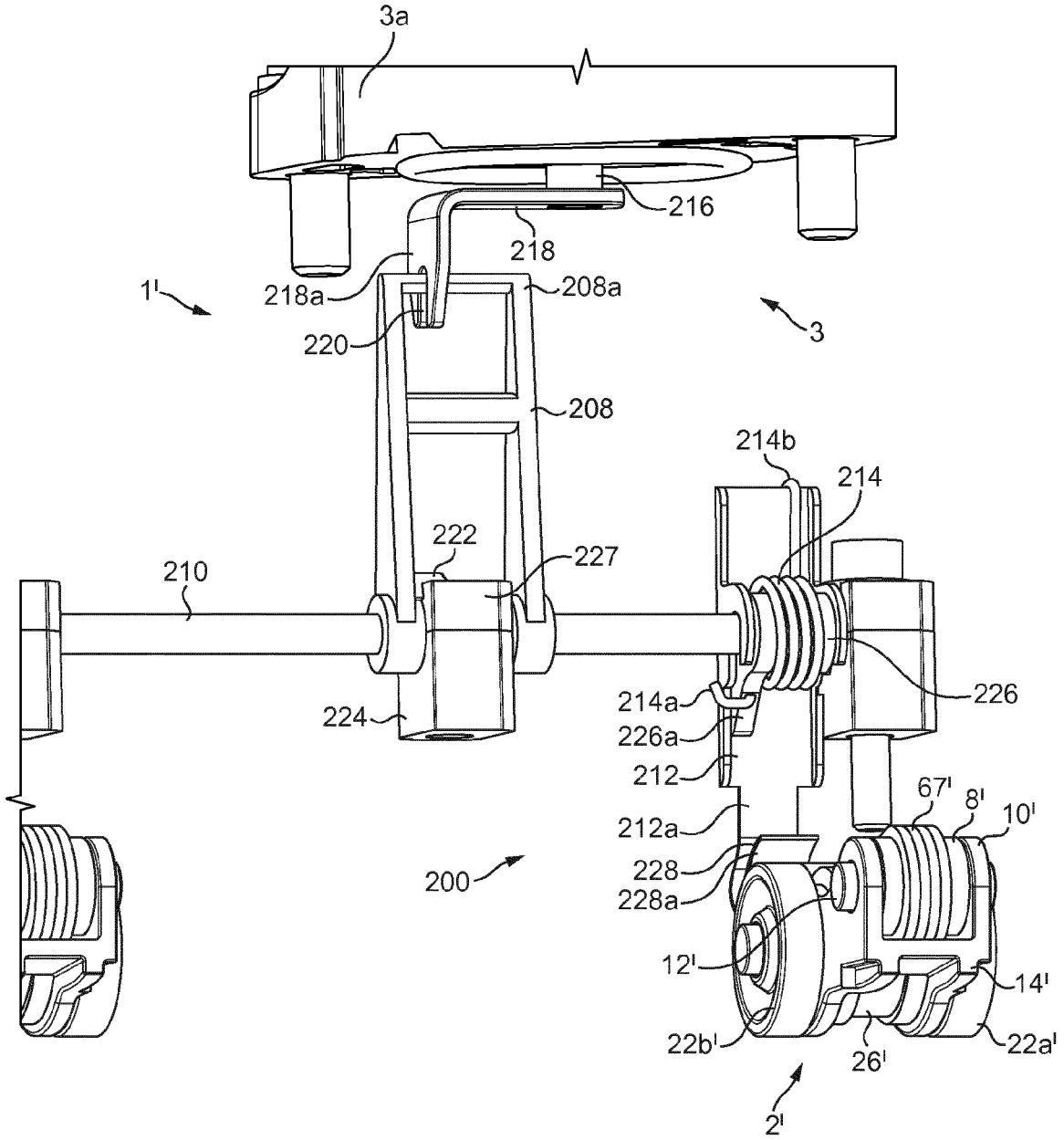
FIG. 7 illustrates a schematic perspective view of a portion of a valve train assembly including a rocker arm and an example actuation transmission apparatus, according to a second example.
Figure 8:
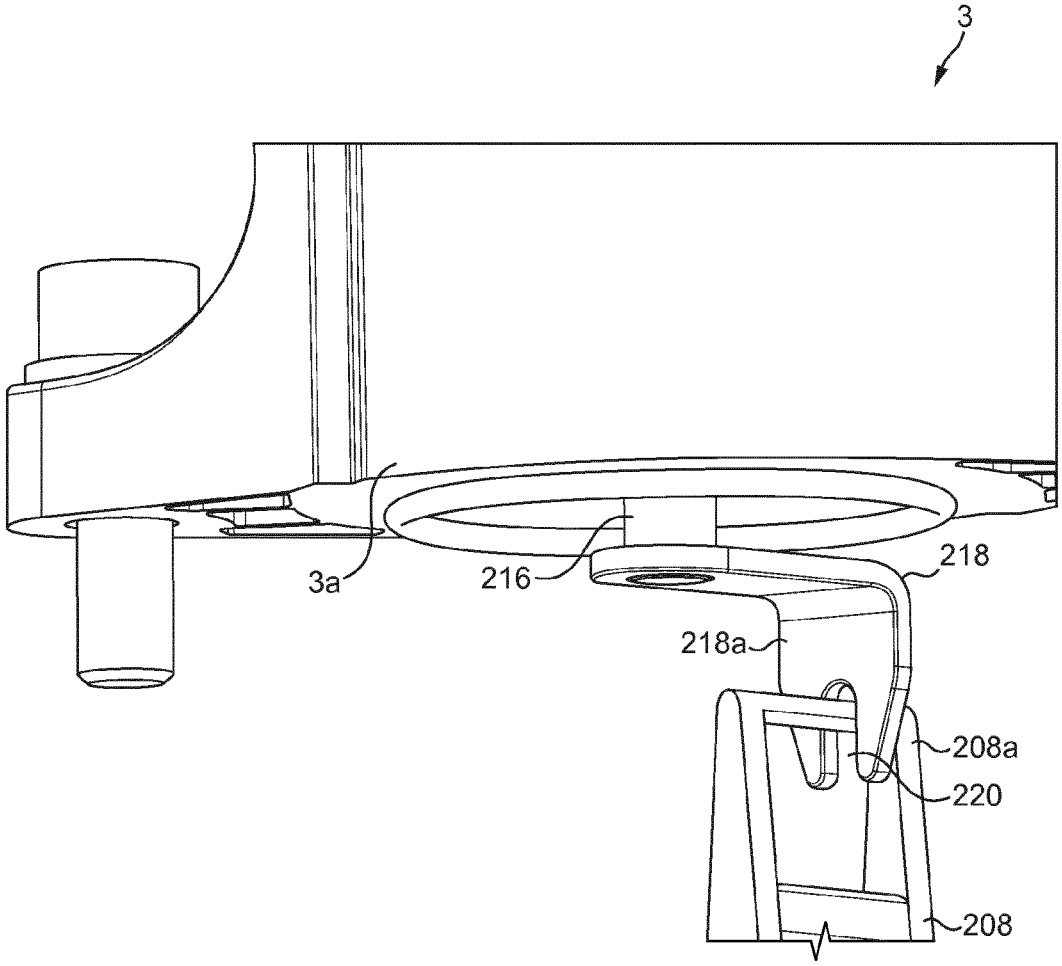
FIG. 8 schematically illustrates a perspective view of a portion of the exemplary actuation transmission apparatus.
Figure 9:
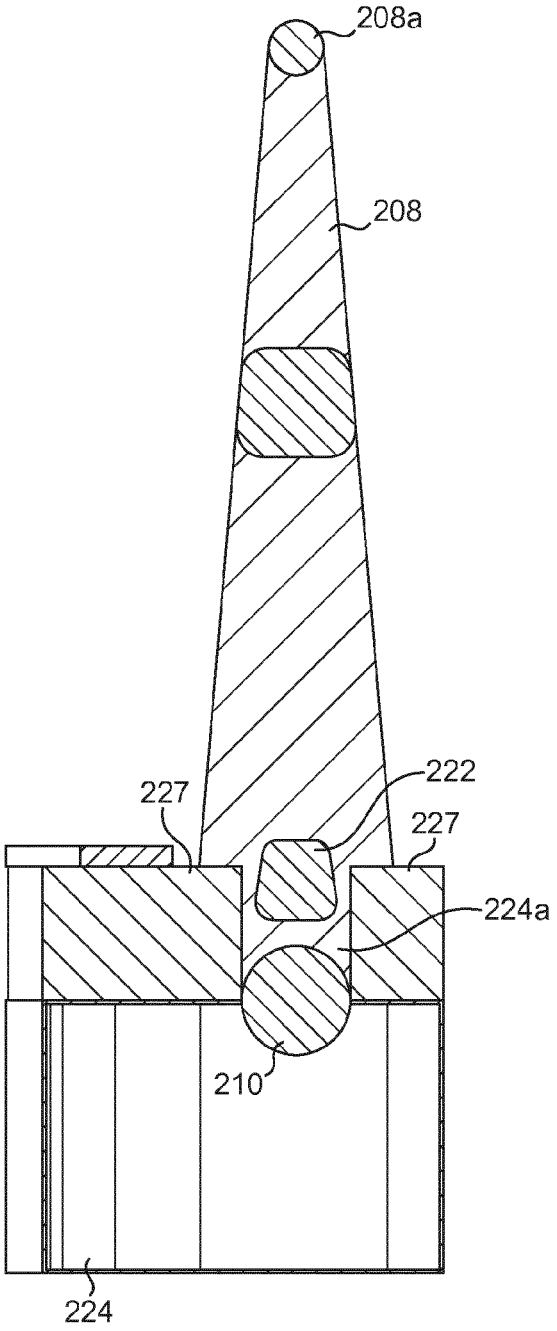
FIG. 9 schematically illustrates a cross section of a portion of the exemplary actuation transmission apparatus.

FIGS. 7 to 9 illustrate a valve train assembly 1', comprising an actuation transmission apparatus 200, according to a second example. Features described with reference to FIGS. 7 to 9 that are the same or similar to those described with reference to FIGS. 1 to 6 are given like reference signs but followed by a prime (').

The actuation transmission apparatus 200 actuates a component (not visible in FIGS. 7 to 9) of a switchable valve train device 2' of the valve train assembly 1' of an internal combustion engine. In this example, the switchable valve train device 2' is a switchable rocker arm 2'. The switchable rocker arm 2' may be the same or similar to the switchable rocker arm 2 described above with reference to FIGS. 1 to 6. In this example, the component of the switchable valve train device 2' that is actuated is a moveable latching arrangement (not visible in FIGS. 7 to 9, but see e.g. latching arrangement 40 described above with reference to FIGS. 1 to 6) of the rocker arm 2'. The latching arrangement comprises a moveable latch pin (not visible in FIGS. 7 to 9, but see e.g. latch pin 80 described above with reference to FIGS. 1 to 6) for latching an inner body 8' and an outer body 10' of the rocker arm 2' together.

The actuation transmission apparatus 200 transmits an actuation signal (force) from an actuation source 3 to the latch pin of the switchable rocker arm 2'.

The inner body 8' and an outer body 10' may be latched together by the moveable latch pin to provide one mode of operation (e.g. a first valve-lift mode, e.g. a dual lift mode as described above) and unlatched, and hence can pivot with respect to each other, to provide a second mode of operation (e.g. a second valve-lift mode, e.g. a single lift mode as described above).

Specifically, the outer body 10' and the inner body 8' are pivotably connected together at a pivot axis 12'. A first end 14' of the outer body 10' contacts a valve stem (not shown in FIGS. 7 to 9) of a valve (not shown in FIGS. 7 to 9) and a second end (not visible in FIGS. 7 to 9) of the outer body 10' contacts a hydraulic lash adjuster (HLA) (not shown in FIGS. 7 to 9). The outer body 10' is arranged to move or pivot about the HLA (not shown in FIGS. 7 to 9). The rocker arm 2' further comprises at the second end (not visible in FIGS. 7 to 9) of the outer body 10' the latching arrangement (not visible in FIGS. 7 to 9, but see e.g. latching arrangement 40 of FIGS. 1 to 6) comprising the latch pin (not visible in FIGS. 7 to 9, but see e.g. latch pin 80 of FIGS. 1 to 6) that can be actuated between a first position in which the outer body 10' and the inner body 8' are un-latched and hence can pivot with respect to each other about the pivot axis 12' and a latched position in which the outer body 10' and the inner body 8' are latched together and hence can move or pivot about the HLA (not shown in FIGS. 7 to 9) as a single body.

The latching arrangement comprises a biasing element (not visible in FIGS. 7 to 9, but see e.g. spring 85 of the latching arrangement 40 of the rocker arm 2 as described above with reference to FIGS. 1 to 6) that biases the latch pin to the unlatched position. Therefore, in a default state, i.e. when substantially no actuation force is applied to the latch pin, the latch pin is urged by the biasing element to its default, unlatched, position.

The inner body 8' is provided with an inner body cam follower 26', for example, a roller follower 26' for following a secondary lift cam (not shown in FIGS. 7 to 9). The outer body 10' is provided with a pair of roller followers **22*a*', 22*b*', for example, main lift rollers 22*a*', 22*b*' arranged on either side of the roller follower 26' for following a pair of main lift cams (not shown in FIGS. 7 to 9). The rocker arm 2' further comprises a return spring arrangement 67' for returning the inner body 8' to its rest position after it is has pivoted with respect to the outer body 10'**.

When the latch pin of the rocker arm 2' is in the latched position, the rocker arm 2' provides a first function, for example, a dual lift mode as described above with reference to FIGS. 1 to 6. When the latch pin of the rocker arm 2' is in the unlatched position, the rocker arm 2' provides a second function, for example, a single lift mode as described above with reference to FIGS. 1 to 6.

It will be appreciated that the rocker arm 2' may be any rocker arm comprising a plurality of bodies that move relative to one another, and which are latched together to provide one mode of operation (valve-lift mode) and are unlatched, and hence can move with respect to each other, to provide a second mode of operation (valve-lift mode). For example, rocker arm 2' may be configured for internal Exhaust Gas Recirculation (iEGR), Cylinder Deactivation (CDA), Early Exhaust Valve Opening (EEVO), or the like applications.

The actuation transmission apparatus 200 comprises a transmission lever 208 for contacting with the actuation source 3, a shaft 210 that is mechanically coupled to the transmission lever 208 such that the shaft 210 is rotatable by the actuation source 3, a shaft support body 224 arranged to support the shaft 210, a contacting element 212 for contacting the latching arrangement of the rocker arm 2', and a biasing device 214 (also referred to herein as a compliance spring 214) to bias the contacting element 212 rotationally with respect to the shaft 210. The actuation transmission apparatus 200 also comprises a preload element 226, attached to the shaft 210, for transferring torque to the biasing device 214 from the shaft 210. The pre-load element comprises a radial protrusion **226*a* for contacting and applying the torque to the biasing device 214**.

The actuation transmission apparatus 200 is arranged to actuate the latch pin of the rocker arm 2' by moving the latch pin from the unlatched to the latched position.

In overview, in use, the biasing device 214 becomes biased by the shaft 210 when the actuation source 3 rotates the shaft 210 (via the lever 208) when the actuation source 3 attempts to actuate the latch pin of the rocker arm 2', via the contacting element 212, at a time when the latch pin cannot be actuated, for example, at a time when the relative orientation of the outer body 10' and the inner body 8' prevents the latch pin from being able to move. The biasing device 214 so energised can then cause the contacting element 212 to actuate the latch pin of the rocker arm 2' when the latch pin next becomes actuatable.

As best seen in FIG. 8, the actuation source 3 (also referred to herein as an actuator 3) comprises a drive rod 216 that can be controlled to rotate about its axis. For example, the rod 216 may be caused to rotate when switching of a mode of operation of the switchable rocker arm is required. The rod 216 may be limited in its extent of rotation, for example only between certain angles. The actuation source 3 comprises a drive element **3*a* that is controllable to cause the rod 216 to rotate. The rod 216 may be controlled to rotate using any suitable drive element 3*a***, such as electrical, hydraulic, and/or pneumatic means.

The rod 216 has a coupler 218 extending radially therefrom for contacting with the lever 208 and transforming, via the lever 208, the rotational movement of the drive rod 216 about the axis of the drive rod 216 into rotational movement of the shaft 210 about the axis of the shaft 210. The axis of the shaft 210 is perpendicular to the axis of the rod 216. The coupler 218 is L shaped and has a mouth portion 220 at its distal end **218*a* for receiving therein a distal end 208*a* of the lever 208**.

The lever 208 is mechanically coupled to the shaft 210, and extends radially therefrom. The lever 208 is generally elongate.

As best seen in FIG. 9 the lever 208 may comprise one or more mechanical stopping features 222 to restrict the rotation of the lever 208 about the axis of the shaft 210 (and hence restrict the rotation of the shaft 210) to within a certain range of angles (i.e. to restrict an extent of rotation of the lever 208 about the axis of the shaft 210). The shaft support body 224 (through which the shaft 210 extends) may comprise one or more protrusions 227 against which the mechanical stopping feature(s) 222 of the lever may abut, thereby to restrict the rotation of the lever 208 about the axis of the shaft 210 (and hence restrict the rotation of the shaft 210) to within a certain range of angles. In this example, the lever 208 comprises two mechanical stopping features 222. Each mechanical stopping feature 222 is a protrusion 222 from the lever 208, located towards the end of the lever 208 connected to the shaft 210. Each protrusion 222 is disposed in a corresponding recess 224*a*, defined between two protrusions 227 of the shaft support body 224. The shaft 210 is received in the recess 224*a*. The extent of rotation of the lever 208 about the axis of the shaft 210 (and hence the extent of the rotation of the shaft 210 itself) is restricted in one direction by the mechanical stopping feature 222 abutting one of the two protrusions 227 of the shaft support body 224, and in the other direction by the mechanical stopping feature 222 abutting the other of the two protrusions 227 of the shaft support body 224. The lever 208 (and hence the shaft 210) is thereby prevented from over-rotating, hence avoiding damage to components on the valve train assembly. A return spring, or any suitable biasing device, may be installed on the shaft 210 and shaft support body 224 to define the positions (initial and final) of the shaft 210. For example the return spring may be arranged to bias the shaft 210 rotationally with respect to the support body. This may ensure a default orientation of the shaft 210 (and hence contacting element 212) is maintained when actuation of the rocker arm 2 is not required.

The shaft 210 is mechanically coupled to the contacting element 212 via the biasing device 214. The biasing device (compliance spring) 214 may be for example a coil spring 214 wrapped around the shaft 210 (or a component 226 thereof). In this example, the compliance spring 214 is a coil spring 214 wrapped around the pre-load element 226 which itself is wrapped around the shaft 210. A first end 214*a* of the compliance spring 214 contacts the radial protrusion 226*a* of the pre-load element 226, and a second end 214*b* of the compliance spring 214 contacts the contacting element 212 thereby to bias the contacting element 212 rotationally with respect to the shaft 210, towards the rocker arm 2. When the shaft 210 rotates, the radial protrusion 226*a* of the pre-load element 226 applies a torque force to the compliance spring 214, thereby energising the compliance spring 214. Therefore, the shaft 210 may rotate with respect to contacting element 212, but in doing so the biasing device (compliance spring) 214 will become energised, and will urge the contacting element 212 to follow the rotation of the shaft 210.

The contacting element 212 is generally elongate and extends radially from the shaft 210. The contacting element 212 has at a first end 212*a*, a contacting feature 228 that contacts with the latching arrangement (not visible in FIGS. 7 to 9) of the rocker arm 2'. The contacting feature 228 may be or comprise a flexible strip 228 and/or may be hook shaped. In this example, the contacting feature 228 defines a curved surface 228*a* for contacting the latching arrangement so as to reduce wear of the contact surface and to enable the contacting element 212 to apply a force on the latch pin towards the outer body 10' of the rocker arm 2' regardless of rotation of the outer body 10' about the hydraulic lash adjuster during the engine cycle.

The actuation transmission apparatus 200, in response to rotation of the rod 216 of the actuator 3, actuates (e.g. moves) the latch pin (not visible in FIGS. 7 to 9) against the biasing element to latch the inner body 8' and the outer body 10' of the rocker arm 2' together. In other words, the latch pin of the rocker arm 2' is actuated when the latch pin is moved, by the contacting element 212, from an unlatched position in which the inner body 8' and the outer body 10' are unlatched so that the inner body 8' and the outer body 10' are moveable relative to one another, to a latched position in which the inner body 8' and the outer body 10' are latched together. When deactivation is required, the actuation transmission apparatus 200 applies substantially no force on the latch pin and the latch pin is de-actuated (e.g. moved) under the force of the biasing element of the latching arrangement to unlatch the inner body 8' and the outer body 10'.

Specifically, when actuation of the latch pin is required, for example when switching of the rocker arm 2' to provide an auxiliary cam lift mode (the dual lift mode) is required, the rod 216 rotates anticlockwise (when looking along the rod 216 towards the drive element 3*a*) which causes, via the lever 208, the shaft 210 to rotate anticlockwise (when looking along the shaft 210 towards the contacting element 212 from the lever 208), which causes the contacting element 212 to be urged, via the biasing device 214, into rotation anticlockwise (when looking along the shaft 210 towards the contacting element 212 from the lever 208) to contact the latching arrangement (not visible in FIGS. 7 to 9) of the rocker arm 2'. Specifically, the rotation of the shaft 210 anticlockwise (when looking along the shaft 210 towards the contacting element 212 from the lever 208, in the sense of FIG. 7) causes the radial protrusion 226*a* of the pre-load element 226 to exert a torque force on the compliance spring 214, which in turn causes the contacting element 212 to be urged into rotation anticlockwise (when looking along the shaft 210 towards the contacting element 212 from the lever 208, in the sense of FIG. 7) to contact the latching arrangement of the rocker arm 2', thereby to urge the latch pin towards and into the rocker arm 2'. In other words, the contacting element 212 exerts a force on the latch pin in a direction towards the inner body 8 and the outer body 10.

If the latch pin of the rocker arm 2' is free to move then the force of the contacting element 212 pushing against the latching arrangement will be sufficient to actuate the latch pin immediately, hence latching the inner body 8' and the outer body 10' together. The rocker arm 2' may therefore be immediately switched from, say, a second lift mode (e.g. single lift mode) to a first lift mode (e.g. dual lift mode).

However, in some cases, the latch pin (not visible in FIGS. 7 to 9) may not be free to move (i.e. it may be blocked). For example, the actuation of the latch pin may not be possible immediately due to an engine condition. For example, a lift profile of a secondary lift cam may be engaged with a secondary lift roller follower 26' of the inner body 8' of the rocker arm 2'. In this case, the inner body 8' will be rotated with respect to the outer body 10', hence blocking the path of the latch pin from moving from the unlatched position to the latched position. In this case, the contacting element 212 will be restricted (blocked) from rotating with the shaft 210 when the shaft 210 is caused to rotate, and instead the rotation of the shaft 210 will cause the biasing device (compliance spring) 214 to be energised (i.e. to elastically deform from its natural configuration). That is, the spring 214 absorbs the actuation signal in case the switchable device 2' cannot be switched directly. As soon as (i.e. the instant that) the latch pin becomes free to move again (i.e. becomes unblocked, e.g. as soon as the secondary lift roller follower 26' is engaged with a base circle of the secondary lift cam and hence the inner body 8' is no longer blocking the path of the latch pin), the energy stored in the biasing of the spring 214 will cause the contacting element 212 to rotate anticlockwise about the shaft 210 (when looking along the shaft 210 towards the contacting element 212 from the lever 208), and hence cause the latch pin to actuate, hence latching the inner body 8' and the outer body 10' together (and hence switching the rocker arm 2' from, say, a second lift mode (e.g. single lift mode) to a first lift mode (e.g. dual lift mode) as described above). That is, as soon as an engine condition allows for the latch pin to be actuated, the biasing device (compliance spring) 214 will return to its natural, non-deformed state, and transmit the actuation signal/energy to the latch pin. That is as soon as the engine condition allows for the switchable valve train device (e.g. rocker arm 2') to be switched, the spring 214 will expand again and transmit the signal to the switchable valve train device (e.g. rocker arm) 2. For example, the latch pin may be free to be actuated as soon as an engine cycle occurs where the inner body 8' is not rotated with respect to the outer body 10', and hence a gap into which the latch pin may move is free.

As a result, regardless of the blocked or unblocked state of the latch pin (i.e. regardless of the switchable or unswitchable state of the switchable valve train component e.g. rocker arm 2'), the latch pin (not visible in FIGS. 7 to 9) may be actuated as soon as it is physically possible to do so, i.e. as soon as the rocker arm 2' is not in a state which blocks actuation of the latch pin (not visible).

In other words, the switching of the rocker arm 2' from, say, a second lift mode (e.g. single lift mode) to a first lift mode (e.g. dual lift mode) as described above, is in effect delayed with respect to the actuation signal/force coming from the actuator 3 to the earliest possible time that such switching is physically possible.

At a later stage, the drive rod 216 of the actuator 3 may return to its original position (e.g. when deactuation of the latch pin is required), and hence the contacting element 212 ceases to apply a force on the latching arrangement (not visible), and hence the latch pin may return to its default, unlatched position under force of the biasing element (not visible in FIGS. 7 to 9) that biases the latch pin to its default, unlatched position.

The above solution allows easy packaging and installation of the actuation transmission apparatus 200 on an engine. As mentioned above, when the actuation of the component (e.g. latch pin) of the switchable valve train device (e.g. rocker arm 2') is not possible immediately due to the engine condition, the transmission apparatus 200 allows for the actuation to happen as soon as possible. The solution allows actuation to be effected by the actuation transmission apparatus 200 by a limited rotation or translation of the actuation system 200, reducing the impact to the engine's layout and the number and complexity of the actuation system components. The installation of the actuation transmission apparatus 200 on the engine is simple since a limited number of installation points are required on the engine and it can be also installed inside plastic covers.

The above are to be understood as illustrative examples only. For example, the storing of the signal/energy/force by the biasing device 214 can be achieved by any suitable elastic element, e.g. any suitable biasing device.

In some examples, the actuation transmission apparatus 200 may actuate a different component of a different switchable valve train device, not necessarily a latch pin of rocker arm 2'.

In some example, the actuation transmission apparatus 200 may transmit the activation signal/force from an actuator 3 rotation, or a linear actuation force, form one point to another.

In some examples, the actuation transmission apparatus 200 may comprise a plurality of such contacting elements 212 for contacting a respective plurality of components of a respective plurality of switchable valve train devices 2' (e.g. a respective plurality of latching arrangements of a respective plurality of rocker arms 2'). In this case, the shaft 210 may be common to each of those plurality of contacting elements 212, so that multiple devices (e.g. rocker arms 2) may be switched at the same time. For example, the actuation transmission apparatus 200 may comprise a shaft 210 rotatable by an actuation source 3, a plurality of contacting elements 212 each mechanically coupled to the shaft 210, each for contacting a respective one of a plurality of components of a respective plurality of switchable valve train devices 2', and a respective plurality of biasing device 214 each to bias a respective one of the plurality of contacting elements 212 rotationally with respect to the shaft 210. In use, for each of the respective biasing device 214, the biasing device 214 becomes biased by the shaft 210 when the actuation source 3 rotates the shaft 210 when the actuation source 3 attempts to actuate the plurality of components of the switchable valve train devices 2', via the respective contacting elements 212, when the respective component is not able to be actuated, whereby the biasing device 214 causes the respective contacting element 212 to actuate the respective component of the respective switchable valve train device 2' when the respective component becomes actuatable again.

In some examples, the actuation transmission apparatus 200 may allow for the actuation of components of various switchable valve train devices (e.g. rocker arm 2') to happen as soon as possible. The actuation transmission apparatus 200 may therefore capture and store the activation signal or energy and transmit it to the component as soon as the actuation can happen. The storing of the signal/energy can be achieved by the means of any elastic element 214.

The mechanical connection between the actuator 3 and the shaft 210 may be for example electrical, hydraulic, and/or pneumatic. This mechanical connection may be the last operation when assembling the engine, hence allowing for convenient assembly.

All of the above examples are to be understood as illustrative examples only. It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1, 1' valve train assembly 2,
2' rocker arm
3. actuation source
3*a* drive element
4 valve
6 hydraulic lash adjuster 8,
8' inner body
10, 10' outer body
12, 12' pivot axis
14, 14' first end of outer body
16 valve stem
20 second end of outer body
22*a,b*, 22*a*',b' main lift rollers
24 axle
26, 26' secondary lift roller
30 three lobed camshaft
32 rotatable cam shaft
34 first main lift cam
36 second main lift cam
38 secondary lift cam
40 latching arrangement
43 axle
46*a,b* apertures
48*a,b* apertures
54 latch contact surface
60, 62 side wall
64*a* base
66 end wall
67, 67' return spring arrangement
68 inner wall
70*a,b* apertures
74*a,b* holes
80 latch pin
84 actuation member
85 spring
86*a,b* apertures
88 shaft
90 roller
92 latch surface
93 end of actuation member
94 actuator
96 actuator shaft
98 flexible strip
100 main lift exhaust valve curve
101 additional lift exhaust valve curve
102 intake valve curve
200 actuation transmission apparatus
208 transmission lever
210 shaft
212 contacting element
214 biasing device (compliance spring)
216 drive rod
218 coupler
220 mouth portion
222 mechanical stopping feature
224 shaft support body
224*a* recess
226 pre-load element
227 protrusion
228 contacting feature
228*a* curved surface

The invention claimed is:

1. A method of actuating a component of a switchable valve train device of an internal combustion engine, the method comprising:

rotating a shaft so as to bias, when the component of the switchable valve train device is not able to be actuated, a biasing device that biases a contacting element rotationally with respect to the shaft, the contacting element being configured to actuate the component of the switchable valve train device, and actuating the biasing device to cause the contacting element to actuate the component of the switchable valve train device when the component of the switchable valve train device is actuatable, wherein the switchable valve train assembly comprises: an actuation source; a switchable valve train device comprising a component and an actuation transmission apparatus for actuating the component, the actuation apparatus comprising:

a shaft rotatable by the actuation source;

a contacting element configured to contact the component and a biasing device configured to bias the contacting element rotationally with respect to the shaft, wherein, the biasing device is biased by the shaft when the actuation source rotates the shaft when the actuation source acts to actuate the component, via the contacting element, when the component is not configured to actuate, the biasing device thereby configured to cause the contacting element to actuate the component when the component is actuatable, wherein the actuation source is configured to rotate a drive rod about an axis of rotation of the drive rod, and wherein the axis of rotation of the drive rod is perpendicular to an axis of rotation of the shaft.

2. An actuation transmission apparatus for actuating a component of a switchable valve train device of an internal combustion engine, the apparatus comprising:

a shaft rotatable by an actuation source;

a contacting element configured to contact the component of the switchable valve train device; and a biasing device configured to bias the contacting element rotationally with respect to the shaft, wherein, the biasing device is configured to be biased by the shaft when the actuation source rotates the shaft to actuate the component of the switchable valve train device, via the contacting element, when the component of the switchable valve train device is not configured to be actuated, the biasing device being configured to cause the contacting element to actuate the component of the switchable valve train device when the component of the switchable valve train device becomes actuatable, wherein the actuation transmission apparatus comprises a lever mechanically coupled to the shaft and extending radially therefrom, the lever being rotatable, by the actuation source, about an axis of the shaft, so that the shaft is rotatable by the actuation source, and wherein the lever comprises one or more mechanical stopping features configured to restrict an extent of rotation of the lever about the axis of the shaft.

3. The actuation transmission apparatus according to claim 2, wherein the actuation transmission apparatus comprises a support body configured to support the shaft, and wherein the support body comprises one or more protrusions configured to abut against the one or more mechanical stopping features of the lever to restrict the extent of rotation of the lever about the axis of the shaft.

4. A valve train assembly of an internal combustion engine, the valve train assembly comprising:

an actuation source;

a switchable valve train device comprising a component; and an actuation transmission apparatus for actuating the component, the actuation apparatus comprising:

a shaft rotatable by the actuation source;

a contacting element configured to contact the component; and a biasing device configured to bias the contacting element rotationally with respect to the shaft, wherein, the biasing device is biased by the shaft when the actuation source rotates the shaft when the actuation source acts to actuate the component, via the contacting element, when the component is not configured to actuate, the biasing device thereby configured to cause the contacting element to actuate the component when the component is actuatable, wherein the actuation source is configured to rotate a drive rod about an axis of rotation of the drive rod, and wherein the axis of rotation of the drive rod is perpendicular to an axis of rotation of the shaft.

5. The valve train assembly according to claim 4, wherein the actuation transmission apparatus comprises a lever mechanically coupled to the shaft and extending radially therefrom, the lever being rotatable, by the actuation source, about the axis of rotation of the shaft, so that the shaft is rotatable by the actuation source, and wherein the actuation source comprises a coupler extending radially from the drive rod and configured to contact the lever, and configured to transform rotational movement of the drive rod about the axis of rotation of the drive rod to rotational movement of the shaft about the axis of rotation of the shaft.

6. A valve train assembly, comprising:

an actuation source connected to a drive rod;

a switchable valve train device comprising a component; and an actuation transmission apparatus for actuating the component, the actuation apparatus comprising:

a shaft rotatable by the actuation source;

a curved surface configured to contact the component of the switchable valve train device; and a coil spring arranged around the shaft and configured to bias the curved surface rotationally with respect to the shaft, wherein the coil spring is configured to be energized by the shaft when the actuation source rotates the shaft wherein the actuation source is configured to rotate the drive rod about an axis of rotation of the drive rod, and wherein the axis of rotation of the drive rod is perpendicular to an axis of rotation of the shaft.

7. The valve train assembly of claim 6, wherein the actuation transmission apparatus comprises a pre-load element configured to transfer a torque from the shaft to the coil spring, the pre-load element comprising a radial protrusion, and wherein a first end of the coil spring contacts the radial protrusion and a second end of the coil spring contacts the curved surface to bias the curved surface rotationally with respect to the shaft.

8. The valve train assembly of claim 6, wherein the curved surface extends radially from the shaft.

9. The valve train assembly of claim 6, wherein the actuation transmission apparatus comprises a lever mechanically coupled to the shaft and extending radially therefrom, the lever being rotatable, by the actuation source, about an axis of the shaft, so as to allow the shaft to be rotatable by the actuation source.

10. The valve train assembly of claim 6, wherein the actuation transmission apparatus comprises a plurality of the curved surfaces each configured to contact a respective component of a plurality of the switchable valve train device, a respective plurality of the coil springs configured to bias each respective curved surface rotationally with respect to the shaft, and wherein the shaft is common to each of the plurality of curved surfaces.

11. A valve train assembly of an internal combustion engine, the valve train assembly comprising:

the actuation transmission apparatus according to claim 2;

the actuation source; and the switchable valve train device comprising the component.

12. The valve train assembly according to claim 11, wherein, when the actuation source rotates the shaft when the component of the switchable valve train device is actuatable, the contacting element is configured to actuate the component of the switchable valve train device immediately.

13. The valve train assembly according to claim 11, wherein the switchable valve train device comprises a switchable rocker arm.

14. The valve train assembly according to claim 13, wherein the switchable rocker arm comprises a first body and a second body, and the component of the switchable rocker arm comprises a latching arrangement comprising a moveable latch pin configured to latch the first body and the second body together.

15. The valve train assembly according to claim 14, wherein actuating the latching arrangement of the switchable rocker arm comprises moving the latch pin from an unlatched position in which the first body and the second body are unlatched so that the first body and the second body are moveable relative to one another, to a latched position in which the first body and the second body are latched together.

16. The valve train assembly according to claim 15, wherein the switchable rocker arm comprises a biasing element configured to bias the latch pin towards the unlatched position.

17. The valve train assembly according to claim 14, wherein when the actuation source rotates the shaft to actuate the latch pin of the switchable rocker arm, the contacting element is caused to exert a force on the latching arrangement in a direction towards the first body and the second body.

18. The valve train assembly according to claim 14, wherein the switchable rocker arm is configured such that, when the first body and the second body are unlatched, the switchable rocker arm provides a first mode of operation, and when the first body and the second body are latched together by the latch pin, the switchable rocker arm provides a second mode of operation.

19. The valve train assembly according to claim 18, wherein the second mode of operation comprises internal exhaust gas recirculation.

* * * * *